US005082603A

United States Patent [19]

Horie et al.

[11] Patent Number: 5,082,603

[45] Date of Patent: Jan. 21, 1992

[54] METHOD OF TREATMENT OF HIGH-LEVEL RADIOACTIVE WASTE

[75] Inventors: Misato Horie, Mito; Masahiro Fukumoto; Masayuki Yoneya, both of Ibaraki, all of Japan

[73] Assignee: Doryokuro Kakunenryo Kaihatsu Jigyodan, Tokyo, Japan

[21] Appl. No.: 668,481

[22] Filed: Mar. 14, 1991

[30] Foreign Application Priority Data

Mar. 15, 1990 [JP] Japan ..... 2-65403

[51] Int. Cl.[5] ..... G21F 9/00

[52] U.S. Cl. ..... 252/628; 252/626; 252/633; 423/2; 423/3; 423/22

[58] Field of Search ..... 252/626, 628, 633; 423/2, 3, 22

[56] References Cited

U.S. PATENT DOCUMENTS

| | | | |
|---|---|---|---|
| 3,979,498 | 9/1976 | Campbell | 423/2 |
| 4,094,809 | 6/1978 | Ross | 252/626 |
| 4,162,231 | 7/1979 | Horwitz et al. | 252/626 |
| 4,528,011 | 7/1985 | Macedo et al. | 65/30.13 |
| 4,938,895 | 7/1990 | Motojima | 252/627 |

OTHER PUBLICATIONS

Duffy, J. I., Treatment, Recovery and Disposal Processes for Radioactive Wastes, 1983, pp. 187-199.

*Primary Examiner*—Brooks H. Hunt
*Assistant Examiner*—Ngoclan T. Mai
*Attorney, Agent, or Firm*—Wenderoth, Lind & Ponack

[57] ABSTRACT

A method of treatment of a high-level radioactive waste containing platinum group elements is provided in which boron and a boron compound is added to a calcined material of the high-level radioactive waste in an amount of 0.5 to 10% by weight in terms of boron as a simple substance, and the resultant mixture is heated at a temperature of about 1000° C. or above under a reduction condition to melt the mixture and to alloy the platinum group elements present in the calcined material with boron. A layer of the resultant platinum group element alloys is then separated and recovered from a layer of residual oxides through sedimentation. The layer of the residual oxides is solidified to form a highly volume-reduced high-level radioactive solidified waste.

6 Claims, 1 Drawing Sheet

METHOD OF TREATMENT OF HIGH-LEVEL RADIOACTIVE WASTE

BACKGROUND OF THE INVENTION

The present invention relates to a method of treatment of a high-level radioactive waste generated, for example, from reprocessing of spent nuclear fuels. More particularly, the present invention is concerned with a method for treating a high-level radioactive waste which comprises adding a suitable amount of boron or a boron compound to a calcined material of the high-level radioactive waste, treating the resultant mixture at a high temperature to alloy platinum group elements contained in the waste with boron, separating and recovering the resultant alloys, and solidifying residual oxides as a solid waste of a high degree of volume reduction.

A high-level radioactive waste generated from reprocessing of spent fuels by purex process is stored in the form of a nitric acid solution containing fission products. This liquid waste is solidified in the future through inclusion in a medium such as glass. Besides glass, many materials such as synthetic rock and the like have been studied as the medium. The concentration of the fission products in the medium is limited to about 10% by weight from the viewpoint of problems such as the solubility of the fission products into the medium, chemical durability (leaching rate in water), and removal of decay heat. The volume of the solidified waste should be as small as possible for the purpose of decreasing the cost of storage and disposal thereof. Although the fission products content of the solidified waste must be increased for this purpose, it is difficult at the present time due to the reasons described above.

Meanwhile, the high-level radioactive waste contains platinum group elements (Ru, Pd and Rh) which are useful but poor in natural resources. Various attempts have been made to recover these elements, and examples of the known method include:

(1) a solvent extraction method wherein these elements are separated from a nitric acid solution of the highd-level radioactive waste by using a phosphoric ester;

(2) a lead extraction method wherein the high-level radioactive waste is vitrified and these elements are extracted from the vitrified waste by using molten lead; and (3) an ion-exchange method wherein these elements are separated by treating a nitric acid solution of the radioactive waste with an ion-exchange resin.

However, these prior art methods of recovering platinum group elements have the following drawbacks.

(1) In the solvent extraction method, the phosphoric ester becomes a secondary waste which is different from the solvent for extraction in the reprocessing, i.e. TBP (tributyl phosphite). This makes it necessary to conduct research and development on a processing method and construction of a processing plant different from those of the waste TBP. The cost necessary for this purpose is very high and causes the cost of the recovery of the platinum group elements to be increased over that of the commercially available platinum group elements, so that the conventional solvent extraction method does not economically pay.

(2) The lead extraction method is advantageous in that lead which becomes a solid waste as it is is used as the extractant. In this method, however, in order to enhance the extraction efficiency, it is necessary to use a low-viscosity glass having a composition different from that of the glass used for the vitrification of the high-level radioactive waste. Further, lead and the platinum group elements should be re-separated, thus rendering this method difficultly applicable to practical use.

(3) The ion exchange method has a problem of safety because a flammable substance is formed when the ion-exchange resin comes into contact with nitric acid.

A large amount of a secondary waste occurs in any of the above-described prior art methods, so that a treatment for remarkably reducing the volume of the high-level radioactive waste cannot be accomplished.

SUMMARY OF THE INVENTION

It is therefore an object of the present invention to provide a novel and improved method for treatment a high-level radioactive waste which can eliminate the above-described drawbacks of the prior art methods and easily recover valuable platinum group elements contained in the radioactive waste.

It is another object of the present invention to provide a novel and improved method of treatment of a high-level radioactive waste which does not generate a large amount of a secondary waste and can obtain a highly volume-reduced high-level radioactive solid waste.

According to the present invention, in order to accomplish the above-described objects, there is provided a method of treatment of a high-level radioactive waste comprising adding boron or a boron compound to a calcined material of the radioactive waste in an amount of 0.5 to 10% by weight in terms of boron as a simple substance, heating the resultant mixture at a temperature of about 1000° C. or above under a reduction condition to melt the mixture and to alloy platinum group elements present in the calcined material with boron, recovering a layer of the resultant platinum group element alloys from a layer of residual oxides through sedimentation, and solidifying the layer of the residual oxides to form a volume-reduced high-level radioactive solidified waste.

The present invention as described above has been made on the basis of our finding that the addition of a suitable amount of boron or a boron compound in the heat melting of the calcined material of the high-level radioactive waste enables a melting treatment temperature to be remarkably lowered because boron alloys with the platinum group elements to form platinum group element alloys which melt at a temperature of about 2000° C. or below.

PREFERRED EMBODIMENTS OF THE INVENTION

Figure 1:
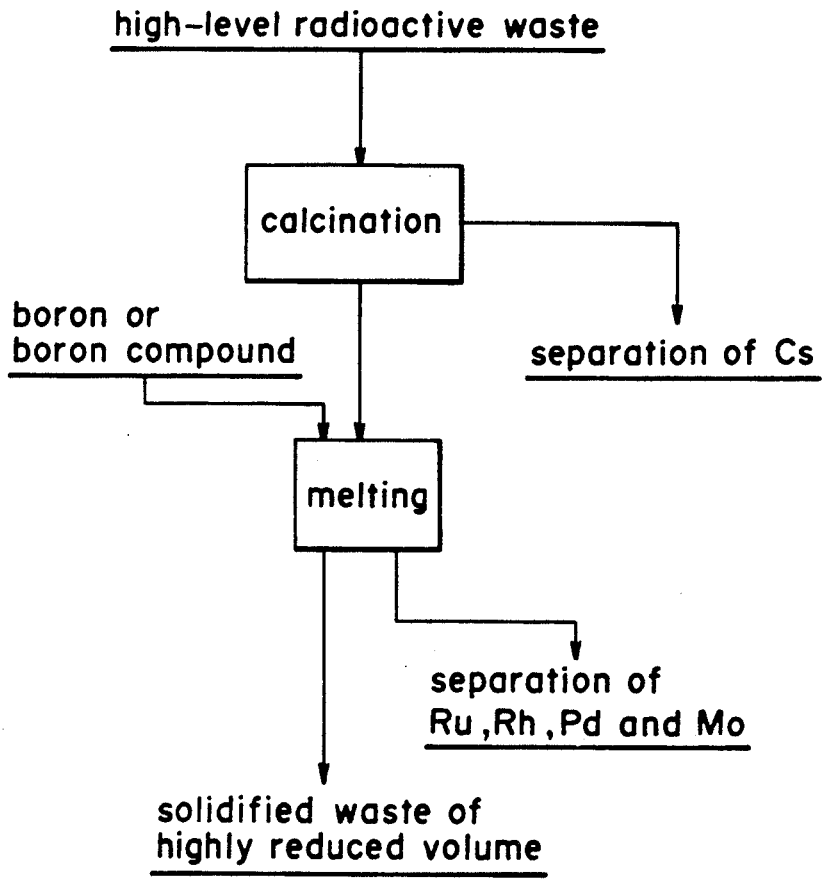
FIG. 1 is an illustrative view of the processing according to the method of the present invention.

A high-level radioactive waste is usually in the form of a nitric acid solution thereof obtained as an extraction residue in the step of reprocessing spent fuels and contains almost all of fission products in the spent fuels. In the present invention, as shown in FIG. 1, the high-level radioactive waste is heated to evaporate water and nitric acid, thereby obtaining a calcined material or a calcination product. Boron or a boron compound is added to the calcined material, and the resultant mixture is melted by heating in a reduction condition at a high temperature of 1000° C. or above. This causes platinum group elements in the calcined material to alloy with boron, and a layer of the resultant platinum group alloys settles down and therefore can be separated from a layer of residual oxides.

Examples of the boron compound to be added to the calcined material include sodium boron hydride, boron nitride and boron carbide. It is a matter of course that the boron compound is not limited to those only. In particular, boron nitride is most suitable because it is easy to handle and low in the cost. The use of boron or a boron compound in an amount of 10% by weight or less in terms of boron as a simple substance will suffice. The addition of boron or a boron compound in a larger amount brings about an increase in the amount of waste and therefore is unfavorable. The amount is preferably 5% or less. The aim of the present invention is to lower the melting point of the platinum group alloy. Although the formation of a eutectic crystal is most desirable for this purpose, an effect can be attained even when boron is added in an amount of 0.5%. Therefore, the amount of addition of boron may be 0.5% or more, preferably 1% or more.

The oxidation-reduction state of the calcined material of the high-level radioactive waste in the heat treatment is controlled by the temperature, atmosphere and addition of a reducing agent. The heating temperature is 1000° C. or above. When the temperature is below 1000° C., Ru and Mo cannot be reduced to metallic state although Pd and Rh are reduced. The temperature is thus preferably 1500° C. or above. Since Ru-, Pd-, Rh-, Mo- and B-base alloys melt at 2000° C. or below, there is no need to employ a temperature above 2000° C. The control of the atmosphere is conducted for accelerating the reduction reaction. In the present invention, the reaction is preferably carried out in an atmosphere of air having a reduced oxygen content, nitrogen or argon. A reducing agent as well is used for accelerating the reduction reaction. Gaseous reducing agents such as hydrogen and carbon monoxide, reducing agents such as carbon which gasify in a redox reaction, and reducing agents such as alkaline earth metals and rare earth elements which are elements constitute the residual oxide layer are used for the purpose of avoiding the occurrence of a secondary waste. It is also possible to use as a reducing agent, substances such as aluminum, which do not have any adverse effect on the residual oxide phase even when it remains as an oxide. The above-described temperature, atmosphere and reducing agent are properly combined with one another depending upon the reaction conditions.

Fission products in spent fuels are broadly classified into (1) metallic elements, (2) non-metallic elements, and (3) rare earth elements. Examples of the metallic elements include alkaline earth metals, transition metals such as Mo, and platinum group elements Most of the non-metallic elements described in the above item (2) and the alkaline earth metals in the metallic elements described in the above item (1) are removed by heating the high-level radioactive waste. Examples thereof include Sb, Te, Cs, and Rb. As a result, in the case of spent fuels of 45000MWD/MTU in the burnup and five years in the cooling time, major components of the calcined material except for elements having a content of 100g/MTU or less are as follows:

Alkaline earth metals (Sr, Ba) ..... 3.3Kg/MTU: 8.7% by weight

Transition metals (Zr, Mo, Tc) ..... 10.5Kg/MTU: 27.9% by weight

Platinum group elements (Ru, Rh, Pd) ..... 5.4Kg/MTU: 14.3% by weight

Rare earth elements (Y, La, Ce, etc.) ..... 18.5Kg/MTU: 49.1% by weight

Total ..... 37.7Kg/MTU

The heat-melting of this calcined material provides a high-level radioactive residual solidified waste having a higher degree of volume reduction than that of a usual solidification product (fission products content: about 10% by weight) of the high-level radioactive waste. It is to be noted that in the case of a vitrification product, the weight thereof is 10 times that of the fission products and the volume thereof is several hundreds of liters per ton of spent fuel, while in the present invention the volume of the volume-reduced residual solidified waste is several tens of liters.

Further, in the present invention, platinum group elements are separated and recovered. As is known, the platinum group element has a small free energy of formation of its oxide and is reduced into a metallic state when heated. The melting point of the platinum group element is 1554° C. for Pd, 1963° C. for Rh, and 2254° C. for Ru. Ru and Rh do not form a solid solution perfectly because they are different from each other in the crystal form. Pd does not form an alloy having a eutectic point with Rh and Ru. Therefore, in the platinum group element and its alloy system, the melting point often exceeds 2000° C., which makes it difficult to separate the platinum group element alone or in the form of an alloy from the residual oxides through melting of the calcined material Namely, even when they can be separated as a phase, a very high melting temperature is required for separating the two layers from each other in the molten state Mo in the calcined material has a relatively small free energy of formation of an oxide and forms an alloy having a low melting point with the platinum group elements. However, the content of Mo and the platinum group elements in the fission products is determined by the burnup of spent fuels. Therefore, it is difficult to realize a composition having the lowest melting point in the respective alloy systems comprising four components.

In the heating step of the present invention, boron or a boron compound is added to the calcined material This causes alloys of Mo or the platinum group elements with boron to be formed, and these alloys melt at a low temperature. In general, numerous elements (M) combine with boron (B) to form an M/B or 2M/B compound. This compound forms a eutectic crystal together with the element (M). The melting point of the eutectic crystal is much lower than those of the original elements. Since the atomic weight of boron is as small as about 11, the weight content of boron in a eutection point with other element is 5% at the highest. Therefore, the amount of boron to be added for the purpose of lowering the melting temperature of the platinum group elements and Mo may be very small. Thus, the platinum group elements and Mo are reduced at a temperature of 2000° C. or below into an easily meltable form, so that a layer of the molten alloys is formed. Since the molten alloy layer separates from the residual oxide layer, the platinum group elements can be recovered and the residual oxide layer becomes a high-level radioactive solidified waste of a high degree of volume reduction.

Figure 2:
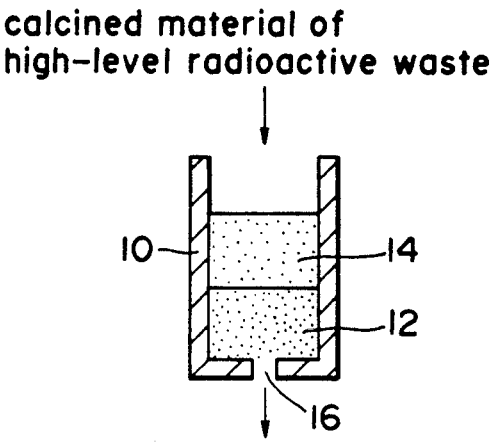
FIG. 2 is a schematic view of one embodiment of an apparatus used for practicing the present invention.

FIG. 2 is a schematic view of one embodiment of an apparatus for practicing the method of the present invention. This apparatus exemplifies a bottom flow type apparatus. A calcined high-level radioactive waste and boron or a boron compound are placed in a melting container 10. The calcined waste is reduced under heating and separated into a layer 12 of platinum group element alloys having a higher specific gravity and a layer 14 of residual oxides having a smaller specific gravity. The platinum group element alloy layer 12 and the oxide layer 14 successively flow down through a flow-down nozzle 16 to be poured into separate containers for solidification.

Figure 3:
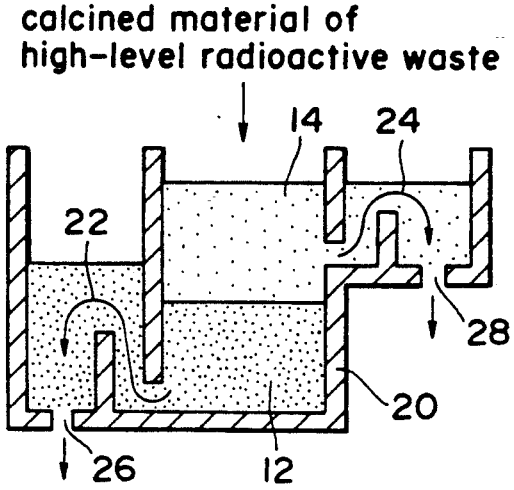
FIG. 3 is a schematic view of another embodiment of an apparatus used for practicing the present invention.

FIG. 3 is a schematic view of another embodiment of an apparatus used for practicing the method of the present invention. This apparatus exemplifies an overflow type apparatus. A calcined high-level radioactive waste and boron or a boron compound are placed in the central part of a melting container 20 to be heat melted. A layer 12 of platinum group element alloys located in the lower part and a layer 14 of residual oxides located in the upper part respectively pass through passages 22, 24, flow down through flow-down nozzles 26 and 28, and are poured into separate containers for solidification.

The construction of the apparatus is not limited to the two types above-described and may be a compromise between the bottom flow type and the overlow type. Namely, the platinum group element alloy layer is flowed down from the bottom and poured into one container for solidification, while the oxide layer is flowed down by overflow and poured into another container for solidification.

For the calcination of the high-level radioactive waste, a rotary kiln system, a microwave heating system, etc., which are under research in relation to vitrification, can be used. For the heat treatment of the calcined waste, a heater system, a direct energization system, a high-frequency heating system, etc., may be employed.

Particular Experimental Examples will now be described hereinbelow.

EXPERIMENTAL EXAMPLE 1

A composition of fission products in a spent fuel of 45000MWD/MTU in the burnup and 5 years in the cooling time was calculated by using ORIGEN code to prepare a simulated waste solution of the corresponding high-level radioactive waste solution. The simulated waste solution was heated to 600° C. to prepare a calcined material.

A mixture of 45g of the calcined material and 5g of boron nitride (BN) were placed in a crucible and heat-treated in an argon atmosphere at 1800° C. for 1 hr. The contents of the container were observed after cooling to reveal that the upper surface is smooth, indicating that the mixture had melted. The crucible was broken and the contents were taken out. The contents were separated into two phases, and a metal mass was present in the bottom and could easily be separated from the residual portion. The metal mass was analyzed with an X-ray micro-analyzer (EPMA). As a result, Ru, Rh, Pd, Mo and B were detected.

The oxide as the residue was subjected to measurement of the leaching rate in water according to JIS R3502. The leaching rate was $8\times10^{-5}$g/cm$^2$ d and substantially the same as that of the vitrification product. Thus it has been confirmed that the residue has a chemical durability sufficient as a high-level radioactive solid waste.

EXPERIMENTAL EXAMPLE 2

The simulated waste solution was treated in the same manner as that of Experimental Example 1, except that the amount of addition of boron nitride was change to 2.5g. The results of observation after the treatment were the same as those of Experimental Example 1.

COMPARATIVE EXAMPLE

An experiment was conducted under the same conditions as those of Experimental Example 1, except that no boron nitride was added. The contents were observed after cooling to reveal that they were in a baked state and no evidence of melting was observed. The mass could easily be taken out of the crucible but did not separate into two phases, so that no metallic mass could be formed.

As described above, the method of the present invention comprises adding boron or a boron compound to a calcined high-level radioactive waste and heat-melting the mixture in a reduction condition at a high temperature of 1000° C. or above. This method makes it possible to separate and recover useful platinum group elements, simplify the treatment process and reduce the size of an apparatus for the treatment. Further, since the resulting residue of oxides is solidified as it is, the solidification is accompanied by such a remarkable volume reduction that the volume is below one-tenth of that of the conventional vitrification. This enables the cost of storage and disposal of the high-level radioactive waste to be remarkably reduced.

In the present invention, the heat-treatment can be conducted at a temperature of 2000° C. or below because boron or a boron compound is added to the waste. Therefore, it becomes possible to adopt a heat-treatment wherein heating is conducted with a heater without the necessity for using a special heating system (e.g., electron beam heating, plasma heating, etc.), and the material for the melting furnace may be zirconia, etc. without the necessity for using special high-melting materials (e.g., thorium oxide), which enables the facilities for treatment to be easily constructed at a low cost.

What is claimed is:

1. A method of treatment of a high-level radioactive waste containing platinum group elements comprising adding boron or a boron compound to a calcined material of the high-level radioactive waste in an amount of 0.5 to 10% by weight in terms of boron as a simple substance, heating the resultant mixture at a temperature of about 1000° C. or above under a reduction condition to melt the mixture and to alloy the platinum group elements present in the calcined material with boron, recovering a layer of the resultant platinum group element alloys from a layer of residual oxides through sedimentation, and solidifying the layer of the residual oxides to form a volume-reduced high-level radioactive solidified waste.

2. The method according to claim 1, wherein the boron compound to be added is boron nitride, sodium boron hydride or boron carbide.

3. The method according to claim 1, wherein heating is carried out in an atmosphere of air having a reduced oxygen content, nitrogen or argon.

4. The method according to claim 1, wherein heating is carried out in the presence of a reducing agent.

5. The method according to claim 4, wherein the reducing agent is hydrogen, carbon monoxide, carbon, alkaline earth metals, rare earth elements or aluminum.

6. The method according to claim 1, wherein heating is carried out at a temperature ranging from about 1500° to about 2000° C.

* * * * *